US007557506B2

(12) United States Patent
Kim et al.

(10) Patent No.: US 7,557,506 B2
(45) Date of Patent: Jul. 7, 2009

(54) PLASMA DISPLAY PANEL

(75) Inventors: Hyun Kim, Suwon-si (KR); Kyoung-Doo Kang, Suwon-si (KR); Se-Jong Kim, Suwon-si (KR); Yun-Hee Kim, Suwon-si (KR); Hyun Soh, Suwon-si (KR); Jin-Won Han, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 278 days.

(21) Appl. No.: 11/511,256

(22) Filed: Aug. 29, 2006

(65) Prior Publication Data

US 2007/0046207 A1 Mar. 1, 2007

(30) Foreign Application Priority Data

Aug. 31, 2005 (KR) ..... 10-2005-0080627

(51) Int. Cl.
*H01J 17/49* (2006.01)

(52) U.S. Cl. ..... 313/582; 313/586; 313/587

(58) Field of Classification Search ..... None
See application file for complete search history.

(56) References Cited

U.S. PATENT DOCUMENTS

| | | | | |
|---|---|---|---|---|
| 5,541,618 | A | 7/1996 | Shinoda | |
| 5,661,500 | A | 8/1997 | Shinoda et al. | |
| 5,663,741 | A | 9/1997 | Kanazawa | |
| 5,674,553 | A | 10/1997 | Sinoda et al. | |
| 5,724,054 | A | 3/1998 | Shinoda | |
| 5,786,794 | A | 7/1998 | Kishi et al. | |
| 5,952,782 | A | 9/1999 | Nanto | |
| RE37,444 | E | 11/2001 | Kanazawa | |
| 6,531,820 | B1 | 3/2003 | Lee et al. | |
| 6,630,916 | B1 | 10/2003 | Shinoda | |
| 6,707,436 | B2 | 3/2004 | Setoguchi et al. | |
| 7,023,135 | B2 * | 4/2006 | Lee | 313/582 |
| 7,420,327 | B2 * | 9/2008 | Fujitani | 313/582 |
| 2003/0146886 | A1 | 8/2003 | Amatsuchi | |
| 2003/0222580 | A1 * | 12/2003 | Amatsuchi | 313/586 |
| 2004/0212305 | A1 | 10/2004 | Fujitani et al. | |
| 2007/0152580 | A1 | 7/2007 | Kim et al. | |
| 2007/0152589 | A1 | 7/2007 | Kim et al. | |
| 2007/0228953 | A1 | 10/2007 | Soh et al. | |
| 2008/0012467 | A1 * | 1/2008 | Negishi | 313/495 |

FOREIGN PATENT DOCUMENTS

| | | |
|---|---|---|
| EP | 1 435 638 | 7/2004 |

(Continued)

OTHER PUBLICATIONS

European Search Report corresponding to European Patent Application No. 06119872.7-2208, issued on Feb. 22, 2007.

(Continued)

*Primary Examiner*—Ashok Patel
(74) *Attorney, Agent, or Firm*—Robert E. Bushnell, Esq.

(57) ABSTRACT

A Plasma Display Panel (PDP) that reduces a discharge voltage includes: a substrate; pairs of sustain electrodes arranged on the substrate; and a dielectric layer covering the pairs of sustain electrodes, the dielectric layer having grooves and the grooves having a plurality of protrusions arranged thereon.

16 Claims, 5 Drawing Sheets

FOREIGN PATENT DOCUMENTS

| | | |
|---|---|---|
| JP | 2845183 | 10/1998 |
| JP | 2917279 | 4/1999 |
| JP | H11-297209 | 10/1999 |
| JP | 2000-315459 | 11/2000 |
| JP | 2001-043804 | 2/2001 |
| JP | 2001-052618 | 2/2001 |
| JP | 2001-176405 | 6/2001 |
| JP | 2001-282185 | 10/2001 |
| JP | 2001-325888 | 11/2001 |
| JP | 2003-051262 | 2/2003 |
| JP | 2003-282008 | 10/2003 |
| JP | 2004-006307 | 1/2004 |
| JP | 2004-284934 | 10/2004 |
| JP | 2005-005189 | 1/2005 |
| JP | 2005-011743 | 1/2005 |
| WO | 98/43270 | 10/1998 |
| WO | WO 03/038853 | 5/2003 |

OTHER PUBLICATIONS

"*Final Draft International Standard*", Project No. 47C/61988-1/Ed. 1; Plasma Display Panels—Part 1: Terminology and letter symbols, published by International Electrotechnical Commission, IEC. in 2003, and Appendix A—Description of Technology, Annex B—Relationship Between Voltage Terms And Discharge Characteristics; Annex C—Gaps and Annex D—Manufacturing.

Japanese Office Action from Japanese Patent Office issued on Applicant's corresponding Japanese Patent Application No. 2006-102033 issued on Jan. 20, 2009.

* cited by examiner

PLASMA DISPLAY PANEL

CLAIM OF PRIORITY

This application makes reference to, incorporates the same herein, and claims all benefits accruing under 35 U.S.C.§119 from an application for THE PLASMA DISPLAY PANEL earlier filed in the Korean Intellectual Property Office on the 31st of Aug. 2005 and there duly assigned Serial No. 10-2005-0080627.

BACKGROUND OF THE INVENTION

1. Field of the Invention

The present invention relates to a Plasma Display Panel (PDP), and more particularly, to a PDP having a reduced discharge voltage.

2. Description of the Related Art

Plasma Display Panels (PDPs) have recently replaced conventional Cathode Ray Tubes (CRTs) displays. In a PDP, a discharge gas is sealed between two substrates on which a plurality of discharge electrodes are formed, a discharge voltage is supplied, phosphors formed in a predetermined pattern by ultraviolet rays generated by the discharge voltage are excited whereby a desired image is obtained.

An AC Plasma Display Panel (PDP) includes a front panel that displays images, and a rear panel combined with the front panel to be parallel thereto. A plurality of pairs of sustain electrodes each having a Y-electrode and an X-electrode are disposed on a front substrate. A plurality of address electrodes are disposed on a rear substrate opposite to a surface of the front substrate, to cross the Y-electrodes and the X-electrodes. Each of the Y-electrodes and the X-electrodes include transparent electrodes and bus electrodes. A space formed by a pair of Y-electrodes and X-electrodes and the address electrodes that cross the pair of Y-electrodes and X-electrodes defines a unit discharge cell that forms one discharge space. A front dielectric layer and a rear dielectric layer are respectively formed on a surface of the front substrate and the rear substrate to cover respective electrodes. A protective layer formed of MgO is formed on the front dielectric layer, and barrier ribs that keep a discharge distance and prevent electrical and optical cross-talk between discharge cells are formed on a front surface of the rear dielectric layer. Red, green, and blue phosphor layers are coated on both sides of each of the barrier ribs and on a front surface of the rear dielectric layer on which the barrier ribs are not formed.

In the PDP, a distance between the Y-electrodes 3 and X-electrodes should be increased so as to improve brightness and luminous efficiency. This is because a discharge area is increased whereby a plasma discharge occurs briskly. However, as the distance increases, a voltage for starting a discharge also increases. Since a rating voltage of electronic elements for driving the Y-electrodes and X-electrodes increases, costs increase.

SUMMARY OF THE INVENTION

The present invention provides a Plasma Display Panel (PDP) having a reduced discharge voltage.

The present invention also provides a PDP having improved brightness and luminous efficiency.

According to one aspect of the present invention, a Plasma Display Panel (PDP) is provided including: a substrate; pairs of sustain electrodes arranged on the substrate; and a dielectric layer covering the pairs of sustain electrodes, the dielectric layer having grooves and the grooves having a plurality of protrusions arranged thereon.

The grooves are preferably arranged between electrodes of the pairs of sustain electrodes.

The protrusions are preferably arranged on side surfaces of the grooves.

The protrusions are preferably arranged on bottom surfaces of the grooves.

The PDP preferably further includes a protective layer covering the protrusions.

The grooves are preferably arranged to expose the substrate through the grooves. The grooves preferably extend along one direction to be parallel to each other. The grooves are preferably discontinuously arranged along one direction.

According to another aspect of the present invention, a Plasma Display Panel (PDP) is provided including: a rear substrate; a front substrate opposing the rear substrate; a plurality of barrier ribs arranged between the front substrate and the rear substrate and partitioning a plurality of discharge cells; pairs of sustain electrodes arranged on the front substrate opposing the rear substrate and separated from each other; address electrodes crossing the pairs of sustain electrodes and arranged on the rear substrate opposing the front substrate; a front dielectric layer covering the pairs of sustain electrodes, the front dielectric layer having grooves and the grooves having a plurality of protrusions arranged thereon; a rear dielectric layer covering the address electrodes; phosphor layers arranged in the discharge cells; and a discharge gas contained within the discharge cells.

The grooves are preferably arranged between electrodes of the pairs of sustain electrodes.

The protrusions are preferably arranged on side surfaces of the grooves. The protrusions are preferably arranged on bottom surfaces of the grooves.

The PDP preferably further includes a protective layer covering the protrusions.

The grooves are preferably arranged to expose the front substrate through the grooves. The grooves preferably extend across the discharge cells. The grooves are preferably discontinuously arranged in each of the discharge cells.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
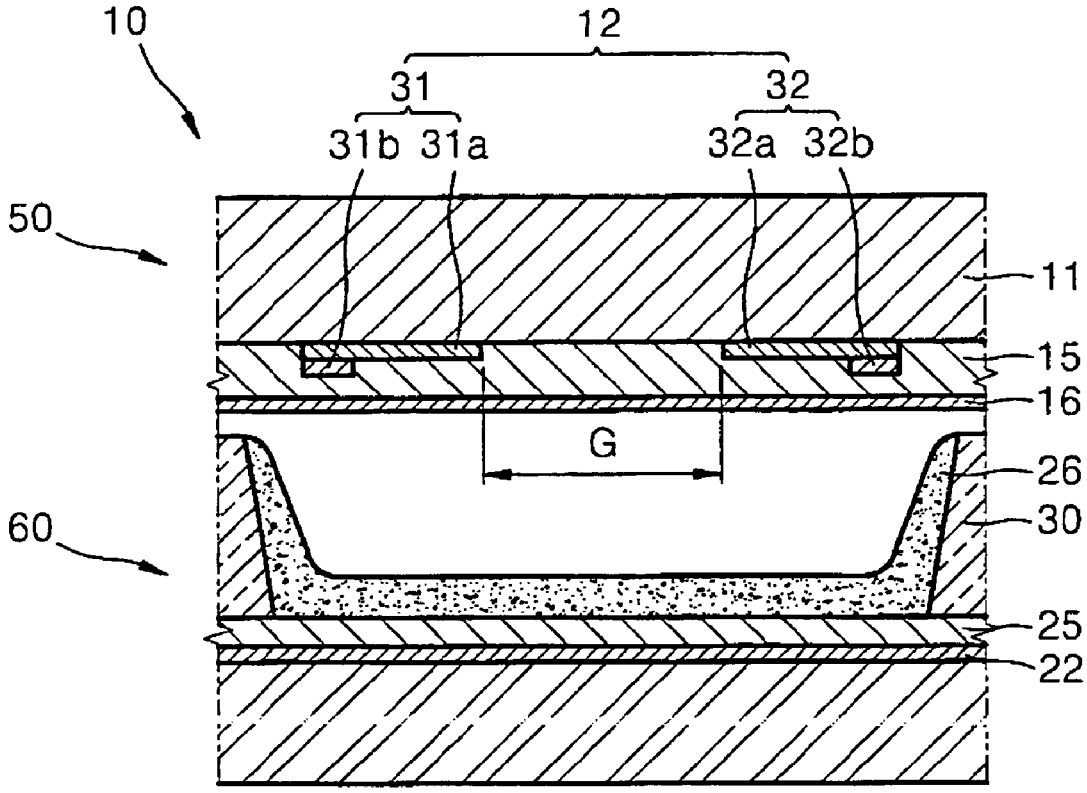
FIG. 1 is a longitudinal cross-sectional view of a Plasma Display Panel (PDP)

Referring to FIG. 1, an AC Plasma Display Panel (PDP) 10 includes a front panel 50 that displays images, and a rear panel 60 combined with the front panel 50 to be parallel thereto. A plurality of pairs of sustain electrodes 12 each having a Y-electrode 31 and an X-electrode 32 are disposed on a front substrate 11. A plurality of address electrodes 22 are disposed on a rear substrate 21 opposite to a surface of the front substrate 11, to cross the Y-electrodes 31 and the X-electrodes 32. Each of the Y-electrodes 31 and the X-electrodes 32 include transparent electrodes 31*a* and 32*a* and bus electrodes 31*b* and 32*b*. A space formed by a pair of Y-electrodes 31 and X-electrodes 32 and the address electrodes 22 that cross the pair of Y-electrodes 31 and X-electrodes 32 defines a unit discharge cell that forms one discharge space. A front dielectric layer 15 and a rear dielectric layer 25 are respectively formed on a surface of the front substrate 11 and the rear substrate 21 to cover respective electrodes. A protective layer 16 formed of MgO is formed on the front dielectric layer 15, and barrier ribs 30 that keep a discharge distance and prevent electrical and optical cross-talk between discharge cells are formed on a front surface of the rear dielectric layer 25. Red, green, and blue phosphor layers 26 are coated on both sides of each of the barrier ribs 30 and on a front surface of the rear dielectric layer 25 on which the barrier ribs 30 are not formed.

In the PDP, a distance G between the Y-electrodes 31 and X-electrodes 32 should be increased so as to improve brightness and luminous efficiency. This is because a discharge area is increased whereby a plasma discharge occurs briskly. However, as the distance G increases, a voltage for starting a discharge also increases. Since a rating voltage of electronic elements for driving the Y-electrodes 31 and X-electrodes 32 increases, costs increase.

Figure 2:
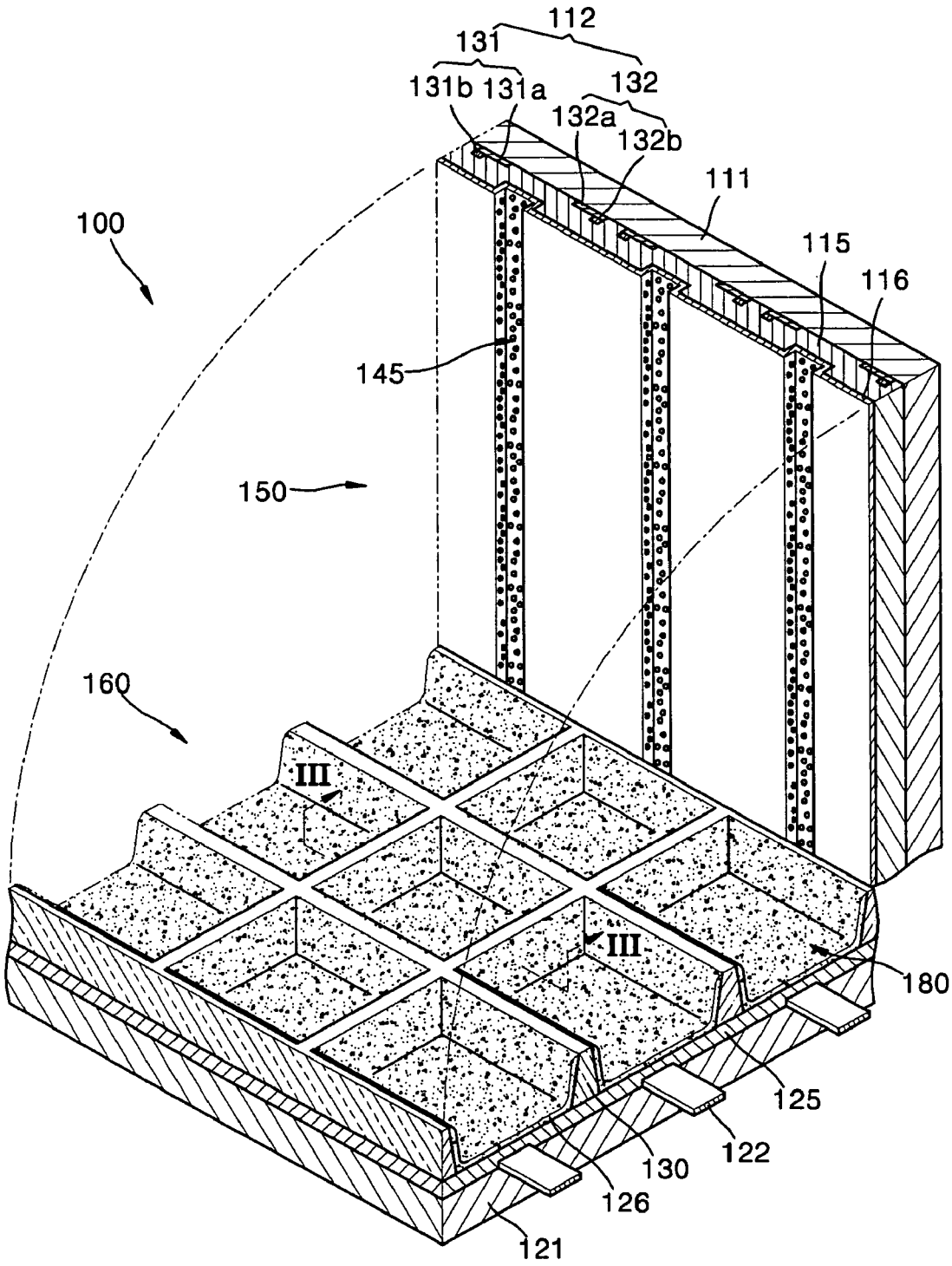
FIG. 2 is an exploded perspective view of a PDP according to an embodiment of the present invention.
Figure 3:
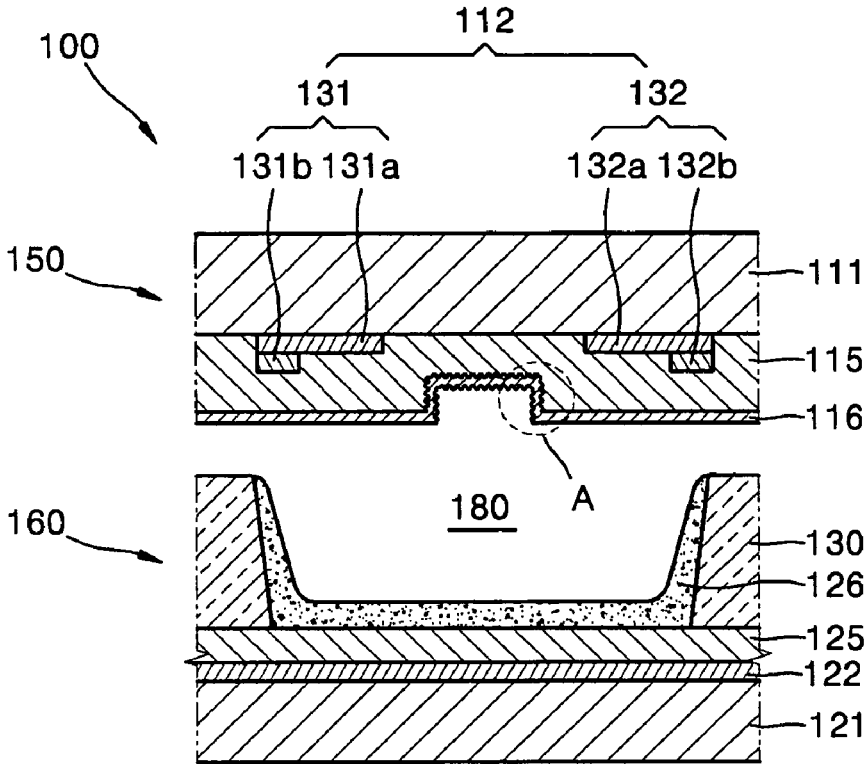
FIG. 3 is a cross-sectional view taken along line III-III of FIG. 2.
Figure 4:
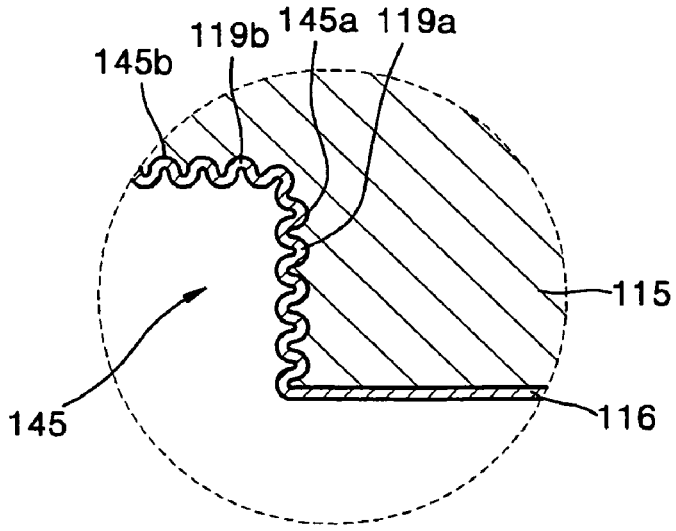
FIG. 4 is an enlarged cross-sectional view of portion A of FIG. 3.

A Plasma Display Panel (PDP) 100 according to an embodiment of the present invention is illustrated in FIGS. 2 through 4. FIG. 2 is an exploded perspective view of a PDP according to an embodiment of the present invention, and FIG. 3 is a cross-sectional view taken along line III-III of FIG. 2. FIG. 4 is an enlarged cross-sectional view of portion A of FIG. 3. Hereinafter, like reference numerals represent like elements.

Referring to FIGS. 2 through 4, the PDP 100 includes a front panel 150 and a rear panel 160 combined with the front panel 150 to be parallel thereto. The front panel 150 includes a front substrate 111, a front dielectric layer 115, a plurality of pairs of sustain electrodes 112, and a protective layer 116. The rear panel 160 includes a rear substrate 121, a plurality of address electrodes 122, a rear dielectric layer 125, barrier ribs 130, and phosphor layers 126.

The front substrate 111 and the rear substrate 121 are separated from each other by a predetermined distance and define a discharge space in which a discharge occurs between the front substrate 111 and the rear substrate 121. The front substrate 111 and the rear substrate 121 can be formed of glass having excellent visible light transmission. However, in order to improve contrast, the front substrate 111 and/or the rear substrate 121 can also be colored.

The barrier ribs 130 are disposed between the front substrate 111 and the rear substrate 121. For example, the barrier ribs 130 can be disposed on the rear dielectric layer 125. The barrier ribs 130 partition the discharge space into a plurality of discharge cells 180 and prevent optical/electrical cross-talk between the discharge cells 180. In FIG. 2, the barrier ribs 130 partition discharge cells arranged in a matrix shape having rectangular cross-sections. However, the present invention is not limited thereto. That is, the cross-sections of the discharge cells 180 can have polygonal shapes, such as triangular or pentagonal shapes or circular shapes or elliptical shapes. Alternatively, the barrier ribs can be open-type barrier ribs, such as stripes. In addition, the barrier ribs 130 can also partition the discharge cells 180 in a waffle or delta arrangement.

The pairs of sustain electrodes 112 are disposed on the front substrate 111 that opposes the rear substrate 121. Each of the pairs of sustain electrodes 112 are a pair of sustain electrodes 131 and 132 formed on a rear surface of the front substrate 111 so as to cause a sustain discharge. The pairs of sustain electrodes 112 are arranged on the front substrate 111 to be parallel to each other and spaced apart by a predetermined distance. One sustain electrode of the pair of sustain electrodes 112 is an X-electrode 131 and acts as a common electrode, and the other sustain electrode thereof is a Y-electrode 132 and serves as a scan electrode. In the current embodiment of the present invention, the pairs of sustain electrodes 112 are disposed on the front substrate 111. However, the position of the sustain electrodes 112 is not limited thereto. For example, the pairs of sustain electrodes 112 can be disposed on the front substrate 111 to be separated from each other by a predetermined distance toward the rear substrate 121.

Each of the X-electrodes 131 and Y-electrodes 132 includes transparent electrodes 131*a* and 132*a* and bus electrodes 131*b* and 132*b*. The transparent electrodes 131*a* and 132*a* are formed of a transparent material, such as Indium-Tin-Oxide (ITO), that is a conductor causing a discharge and allowing light emitted from the phosphor layers 126 to proceed toward the front substrate 111. However, a transparent conductor, such as ITO, has large resistance. Thus, when the sustain electrodes 112 are formed by only transparent electrodes, a large voltage drop occurs in a lengthwise direction of the sustain electrodes 112 such that a large driving power is consumed and the response speed is reduced. To solve the problem, bus electrodes 131*b* and 132*b* are formed of a metallic material and have small line widths, the bus electrodes 131*b* and 132*b* being arranged on the transparent electrodes 131*a* and 132*a*. The bus electrodes can be formed as a single layer structure using a metal, such as Ag, Al or Cu, but can also be formed as a multi-layered structure using a metal, such as Cr/Al/Cr. The transparent electrodes 131*a* and 132*a* and the bus electrodes 131*b* and 132*b* are formed by either photoetching or photolithography.

The bus electrodes 131*b* and 132*b* are separated from the unit discharge cells 180 by a predetermined distance to be parallel to each other and extend across the discharge cells 180. As described above, the transparent electrodes 131*a* and 132*a* are respectively electrically connected to the bus electrodes 131*b* and 132*b*. The transparent electrodes 131*a* and 132*a* having rectangular shapes and are discontinuously disposed in each of the unit discharge cells 180. One side of the transparent electrodes 131*a* and 132*a* is respectively connected to the bus electrodes 131*b* and 132*b*, and the other side of the transparent electrodes 131*a* and 132*a* is disposed toward a central direction of the discharge cells 180.

The front dielectric layer 115 is formed on the front substrate 111 to cover the pairs of sustain electrodes 112. The front dielectric layer 115 prevents adjacent X-electrodes 131 and Y-electrodes 132 from being electrically shorted during a discharge, prevents positive ions or electrons from directly colliding with the X-electrodes 131 and the Y-electrodes 132 and prevents the X-electrodes 131 and the Y-electrodes 132 from being damaged. The front dielectric layer 15 induces charges. The front dielectric layer 15 is formed of PbO, $B_2O_3$, or $SiO_2$, for example.

A plurality of grooves 145 are formed in the front dielectric layer 115 between the X-electrodes 131 and the Y-electrodes 132. The grooves 145 are formed to a predetermined depth of the front dielectric layer 115. Depths of the grooves 145 are determined in consideration of the possibility of damage of the front dielectric layer 115 caused by a plasma discharge, the arrangement of wall charges, and the size of a discharge voltage. For example, the grooves 145 can be formed so that the front substrate 111 is exposed through the grooves 145.

Referring to FIGS. 2 and 3, one groove 145 corresponds to each discharge cell 180. However, the present invention is not limited to this, and the grooves 145 respectively correspond to the discharge cells 180. In addition, the same number of grooves 145 does not need to correspond to each of the discharge cells 180. For example, a different number of grooves 145 can be formed in red light-emitting discharge cells, green light-emitting discharge cells, and blue light-emitting discharge cells.

Since the thickness of the front dielectric layer 115 is reduced by forming the grooves 145, visible light transmission in a forward direction is improved. The grooves 145 have substantially rectangular cross-sections. However, the present invention is not limited to this and the grooves 145 can be formed in various shapes.

Figure 5:
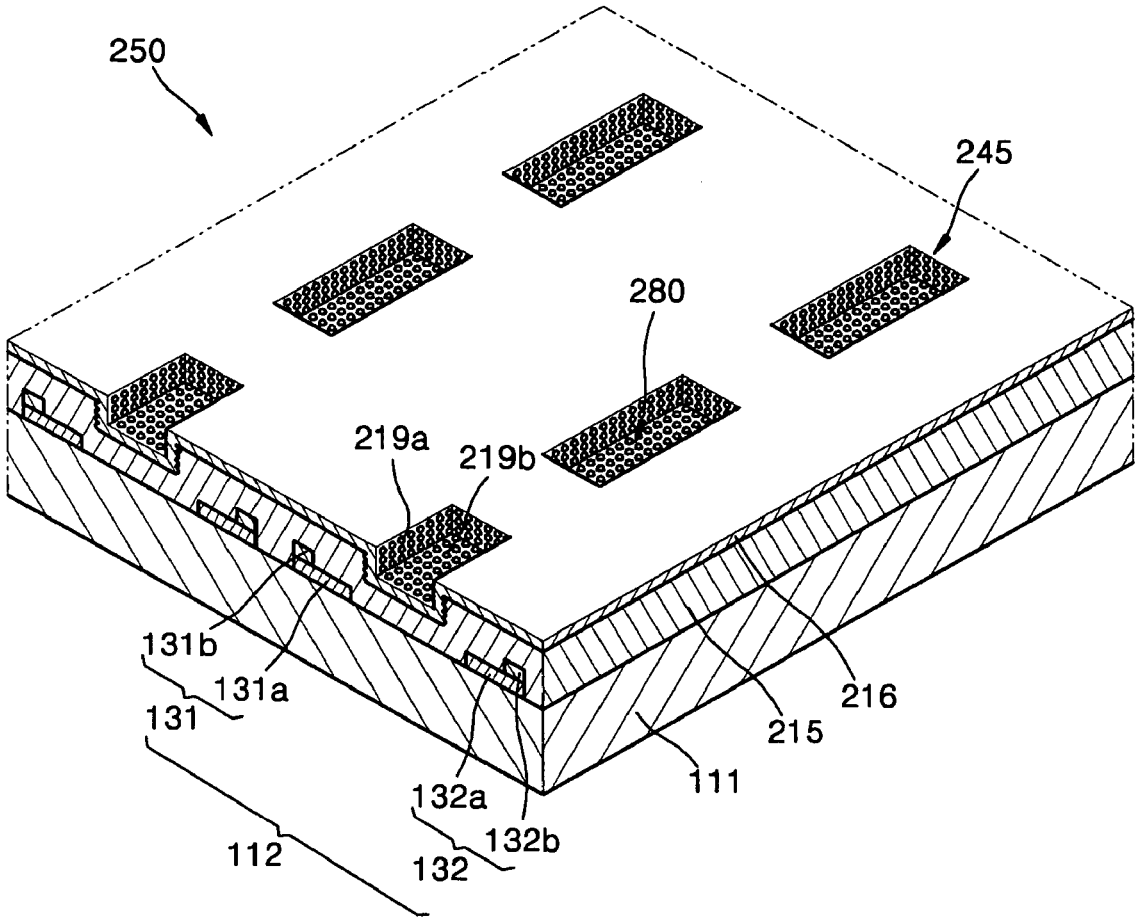
FIG. 5 is a modified example of an embodiment of the present invention and a partial perspective view of a front panel for explaining that grooves are discontinuously formed.

Referring to FIG. 2, the grooves 145 extend across the discharge cells 180 between the X-electrodes 131 and the Y-electrodes 132. The grooves 145 provides an exhausting path of an impurity gas filled in the discharge space during an exhausting process and provides an inlet path of a discharge gas during an injecting process. However, as illustrated in a front panel 250 of a PDP of FIG. 5, the grooves 245 can be discontinuously formed in a front dielectric layer 215 in each of the discharge cells 280. A protective layer 216 is formed on the front dielectric layer 215 and protrusions 219*a* and 219*b*.

Referring to FIGS. 2 through 4, a plurality of protrusions 119*a* and 119*b* are formed on the grooves 145. The protrusions 119*a* and 119*b* can have conical or semicircular shapes. However, the present invention is not limited to this. In addition, the protrusions 119*a* and 119*b* do not need to have the same shape. When voltages are supplied to the X-electrodes 131 and the Y-electrodes 132, electric fields are intensively generated in the protrusions 119*a* and 119*b* having sharp shapes. A detailed description thereof is described later.

Figure 6:
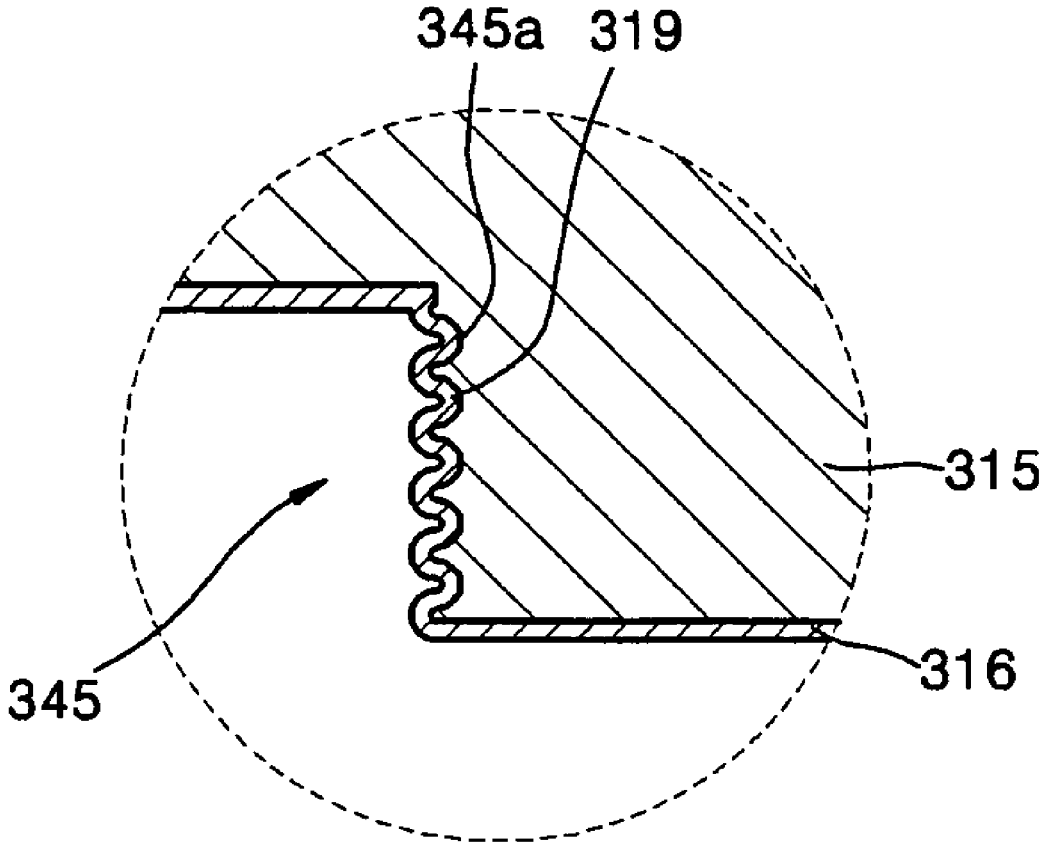
FIG. 6 is a modified example of portion A of FIG. 3 and an enlarged cross-sectional view for explaining that protrusions are formed in different positions of the grooves.

The protrusions 119*a* and 119*b* can be formed in various positions of the grooves 145. The protrusions 119*a* and 119*b* can be formed on both side surfaces 145*a* and bottom surfaces 145*b* of the grooves 145. Referring to FIG. 4, the protrusions 119*a* are formed on the side surfaces 145*a* of the grooves 145 and the protrusions 119*b* are formed on the bottom surfaces 145*b* of the grooves 145. However, the present invention is not limited to this. For example, referring to FIG. 6, protrusions 319 can be formed only on both sides 345*a* of the grooves 345 formed in the front dielectric layer 315. A protective layer 316 is formed on the front dielectric layer 315.

The PDP 100 can further include a protective layer 116 that covers the front dielectric layer 115. The protective layer 116 prevents charged particles or electrons from colliding with the front dielectric layer 115 and prevents the front dielectric layer 115 from being damaged during a discharge. In particular, since electric fields are intensively generated in the protrusions 119*a* and 119*b*, the front dielectric layer 115 can be covered by the protective layer 116 so as to prevent damages. In addition, the protective layer 116 emits a large amount of secondary electrons during a discharge so that a plasma discharge is briskly performed. The protective layer 116 that performs this function is formed of a material having a high secondary electron emission coefficient and excellent visible light transmission. After the front dielectric layer 116 is formed, the protective layer 116 is formed of a thin layer using sputtering or electron beam deposition.

The address electrodes 122 are disposed on the rear substrate 121 that opposes the front substrate 111. The address electrodes 122 extend across the discharge cells 180 to intersect the X-electrodes 131 and the Y-electrodes 132.

The address electrodes 122 are used to generate an address discharge in order to more easily effect a sustain discharge between the X-electrodes 131 and the Y-electrodes 132. More specifically, the address electrodes 122 reduce voltage required for a sustain discharge. The address discharge occurs between the Y-electrodes 132 and the address electrodes 122. If the address discharge is terminated, wall charges are accumulated on the Y-electrodes 132 and the X-electrodes 131 such that a sustain discharge between the X-electrodes 131 and the Y-electrodes 132 occurs more easily.

A space formed by the pair of X-electrode 131 and Y-electrode 132 and the address electrodes 122 intersecting the pair of X-electrode 131 and Y-electrode 132 forms the unit discharge cells 180.

The rear dielectric layer 125 is disposed on the rear substrate 121 so as to cover the address electrodes 122. The rear dielectric layer 125 is formed of a dielectric substance that prevents charged particles or electrons from colliding with the address electrodes 122 during a discharge, prevents the address electrodes 122 from being damaged and that induces charges. The dielectric substance can be PbO, $B_2O_3$, or $SiO_2$.

Phosphor layers 126 producing red, green, and blue light are disposed on both sides of the barrier ribs 130 formed on the rear dielectric layer 125 and on a front surface of the rear dielectric layer 125 on which the barrier ribs 130 are not formed. The phosphor layers 126 include components that emit visible light rays from ultraviolet (UV) rays. The phosphor layers 126 formed in red discharge cells include phosphors such as $Y(V,P)O_4$:Eu, the phosphor layers 126 formed in green discharge cells include phosphors such as $Zn_2SiO_4$:Mn, and the phosphor layers 126 formed in blue discharge cells include phosphors such as BAM:Eu.

A discharge gas in which neon (Ne) and xenon (Xe) are mixed is contained within the discharge cells 180. The front and rear substrates 111 and 121 are sealed and combined using a sealing member, such as frit glass, formed at edges of the front and rear substrates 111 and 121.

The operation of the PDP 100 having the above structure according to the present invention is as follows.

A plasma discharge that occurs in the PDP 100 includes an address discharge and a sustain discharge. The address discharge occurs when an address discharge voltage is supplied between the address electrodes 122 and the Y-electrodes 132. Discharge cells 180 in which a sustain discharge will occur as a result of the address discharge are selected.

After that, a sustain voltage is supplied between the X-electrodes 131 and the Y-electrodes 132 of the selected discharge cells 180. Electric fields are intensively generated in the grooves 145 formed in the front dielectric layer 115. This is because a discharge path between the X-electrodes 131 and the Y-electrodes 132 is reduced, electric fields are intensively generated on the discharge path and densities of charges, charged particles, and excited species are high. In particular, since the protrusions 119*a* and 119*b* have relatively sharp shapes, relatively strong electric fields are generated in sharp portions of the protrusions 119*a* and 119*b*. Thus, since a sustain discharge between the protrusions 119*a* and 119*b* starts, a discharge start voltage can be reduced. In addition, the discharge is gradually spread outside the grooves 145. Even when the discharge is spread, since charged particles are briskly formed by forming the grooves 145 and the protrusions 119*a* and 119*b*, the discharge sustain voltage can be reduced.

The energy level of the excited discharge gas during the sustain discharge is reduced and UV rays are emitted. The UV rays excite the phosphor layers 126 in the discharge cells 180. The energy level of the excited phosphor layers 126 is reduced, visible light is emitted, and the emitted visible light passes through the front dielectric layer 115 and the front substrate 111, thereby forming an image that a user can recognize.

The PDP according to the present invention has the following effects. First, electric fields are intensively generated in the protrusions 119*a* and 119*b* formed on the grooves 145 of the front substrate 111 such that a sustain discharge starts in the protrusions 119*a* and 119*b*. Thus, the discharge start voltage and the discharge sustain voltage are reduced. In addition, by forming the grooves 145 and the protrusions 119*a* and 119*b*, a discharge occurs briskly such that the luminous efficiency and brightness are improved. Second, since the thickness of the front dielectric layer 115 is reduced, visible light transmission is improved.

While the present invention has been particularly shown and described with reference to exemplary embodiments thereof, it is understood that various modifications in form and detail can be made therein without departing from the spirit and scope of the present invention as defined by the following claims.

What is claimed is:

1. A Plasma Display Panel (PDP), comprising:

a substrate;

pairs of sustain electrodes arranged on the substrate; and a dielectric layer covering the pairs of sustain electrodes, the dielectric layer having grooves and the grooves having a plurality of protrusions arranged on surfaces thereof.

2. The PDP of claim 1, wherein the grooves are arranged between electrodes of the pairs of sustain electrodes.

3. The PDP of claim 1, wherein the protrusions are arranged on side surfaces of the grooves.

4. The PDP of claim 1, wherein the protrusions are arranged on bottom surfaces of the grooves.

5. The PDP of claim 1, further comprising a protective layer covering the protrusions.

6. The PDP of claim 1, wherein the grooves are arranged to expose the substrate through the grooves.

7. The PDP of claim 1, wherein the grooves extend along one direction to be parallel to each other.

8. The PDP of claim 1, wherein the grooves are discontinuously arranged along one direction.

9. A Plasma Display Panel (PDP), comprising:

a rear substrate;

a front substrate opposing the rear substrate;

a plurality of barrier ribs arranged between the front substrate and the rear substrate and partitioning a plurality of discharge cells;

pairs of sustain electrodes arranged on the front substrate opposing the rear substrate and separated from each other;

address electrodes crossing the pairs of sustain electrodes and arranged on the rear substrate opposing the front substrate;

a front dielectric layer covering the pairs of sustain electrodes, the front dielectric layer having grooves and the grooves having a plurality of protrusions arranged on surfaces thereof;

a rear dielectric layer covering the address electrodes;

phosphor layers arranged in the discharge cells; and a discharge gas contained within the discharge cells.

10. The PDP of claim 9, wherein the grooves are arranged between electrodes of the pairs of sustain electrodes.

11. The PDP of claim 9, wherein the protrusions are arranged on side surfaces of the grooves.

12. The PDP of claim 9, wherein the protrusions are arranged on bottom surfaces of the grooves.

13. The PDP of claim 9, further comprising a protective layer covering the protrusions.

14. The PDP of claim 9, wherein the grooves are arranged to expose the front substrate through the grooves.

15. The PDP of claim 9, wherein the grooves extend across the discharge cells.

16. The PDP of claim 9, wherein the grooves are discontinuously arranged in each of the discharge cells.

* * * * *